United States Patent [19]

Rennhofer

[11] 4,294,257

[45] Oct. 13, 1981

[54] HALTER TOP FOR SPORTS SUIT

[76] Inventor: Linda Rennhofer, c/o Ronald M. Lieberman, Suite 201, 2 Gloucester St., Toronto, Ontario, Canada, M4Y 1L5

[21] Appl. No.: 39,298

[22] Filed: May 15, 1979

[30] Foreign Application Priority Data

Apr. 24, 1979 [CA] Canada ..... 326248

[51] Int. Cl.[3] ..... A41C 3/00; A41D 5/00; A47K 13/00

[52] U.S. Cl. ..... 128/495; 128/493; 2/67; 2/238; 2/406

[58] Field of Search ..... 128/495, 493, 502, 510; 2/67, 406, 22, 238, 227

[56] References Cited

U.S. PATENT DOCUMENTS

| | | | |
|---|---|---|---|
| 2,049,569 | 8/1936 | Price | 2/22 |
| 2,430,877 | 11/1947 | Kay | 128/493 |
| 2,484,467 | 10/1949 | Schacht | 128/493 |
| 2,632,177 | 3/1953 | Bigger | 2/406 |
| 2,678,446 | 5/1954 | Fellner | 128/495 |

*Primary Examiner*—Doris L. Troutman
*Attorney, Agent, or Firm*—Birch, Stewart, Kolasch & Birch

[57] ABSTRACT

A halter top which is made of non-stretchable or slightly stretchable material is provided for sports use, e.g., as a jogging outfit for females. The halter top consists of the combination of a body encircling portion constituted by a discontinuous panel having a pair of free lateral edges and cooperating means at the free lateral edges to hold such free lateral edges together and means for adjustably securing such halter top to the upper chest portion of a female body by means, e.g., of shoulder straps which adjust the distance from the breasts to the top of the shoulder. The body encircling portion includes a pair of breast receiving and supporting cups including a vertical seam bisecting each breast cup, the preselected variable, but permanent, location of said vertical seam thereby providing preselected different cup sizes. The top edge of the breast receiving and supporting cups is so curved as to follow the natural incline of the breasts. The lower edge of the breast receiving and supporting cups is so curved as to fit below the breasts. By this construction, the breasts are held firmly yet comfortably against the body, with the breasts being urged towards each other and inwardly towards the body. Adjustability in the amount by which the breasts are urged towards one another is provided by means constituted mainly by the cooperating means for adjustably interconnecting the free lateral edges with a predetermined spacing therebetween while thus simultaneously separating one such breast cup from its adjacent such breast cups, e.g., a lacing between the two breast cups.

12 Claims, 10 Drawing Figures

HALTER TOP FOR SPORTS SUIT

BACKGROUND OF THE INVENTION (i) Field of the Invention

This invention relates to a sports outfit, e.g. a jogging outfit for females. More particularly, it relates to a halter top for a sports outfit specially adapted for use as a jogging outfit to be worn by females, either alone, or in combination with shorts to provide a complete sports, e.g. jogging outfit to be worn by females.

(ii) Description of the Prior Art

One of the problems which females encounter in many sports endeavours, especially while jogging, is that of bouncing breasts. It would, therefore, be desirable to provide a top for such a sports outfit which provides adequate support and freedom of movement, and would gently but firmly press the breasts towards the centre of the chest and to hold them there comfortably while yet allowing freedom of movement.

It would also be desirable to provide such a top which would cut down on chaffing and irritation.

Another problem lies in discomfort when wearing shorts. It would, therefore, be desirable to provide shorts for use as a sports outfit, e.g., jogging shorts which can be adjusted at will to re-align the leg openings. Such shorts should also be comfortable and not restrict freedom of movement.

SUMMARY OF THE INVENTION (i) Aims of the Invention

Accordingly, it is an object of this invention to provide an improved such halter top for a sporting outfit for females.

Another object of this invention is the provision of an improved such shorts for a sporting outfit for females.

(ii) Statement of the Invention

By this invention, a halter top is provided for a sports outfit for females comprising the combination of: (a) a body encircling portion constituted by a discontinuous panel having a pair of free lateral edges and cooperating means at said free lateral edges to hold said free lateral edges together, said body encircling portion being provided with (i) a pair of discrete, separated breast-receiving and supporting cups, each said cup including a vertical seam therein bisecting said cup, the preselected variable but permanent location of said vertical seam thereby providing preselected different cup sizes, the top edge of said breast-receiving and supporting cup being so curved as to follow the natural incline of said breasts, the lower edge of said breast-receiving and supporting cups being so curved as to fit below the breasts, and (ii) means constituted mainly by said cooperating means for adjustably interconnecting said free lateral edges with a predetermined spacing therebetween while thus simultaneously separating one such breast cup from its adjacent such breast cup; and (b) means for adjustably securing the halter top to the upper chest portion of a female body; whereby, in use, the breasts are held firmly yet comfortably against the body, with the breasts being urged towards each other and inwardly towards the body.

(iii) Other Features of the Invention

By one feature of this invention, the cooperating means comprises facings between the free lateral edges.

By another feature, the cooperating means comprises vertical pockets adjacent each free lateral edge, and string means disposed within such pockets and secured together.

By yet another feature, the means for adjustably securing the halter top to the body comprises a pair of spaced-apart shoulder straps, extending between the upper edge of the breast receiving and supporting cups and the central area of the back of the body encircling portion, the straps being adjustable in length to adjust the distance from the breasts to the top of the shoulder.

By still another feature, the means for adjustably securing the halter top to the body comprises straps extending from the string means at the front between the breast receiving and supporting pockets to spaced-apart areas at the upper back edge of the halter top, the straps being adjustable in length to adjust the distance from the breasts to the top of the shoulder.

By another feature of this invention, a halter top is provided which is formed of substantially non-stretchable material for a sports outfit for females comprising the combination of:

(a) a principal body encircling portion constituted by a discontinuous panel having a pair of free lateral edges and cooperating means at said free lateral edges to hold said free lateral edges together, said body encircling portion being provided with (i) a pair of discrete, separated breast-receiving and supporting cups, each said cup including a vertical seam therein bisecting said cup, the preselected variable, but permanent, location of said vertical seam thereby providing preselected different cup sizes, the top edge of said breast-receiving and supporting cup being so curved as to follow the natural incline of said breasts, the lower edge of said breast receiving and supporting cups being so curved as to fit below the breasts, and (ii) means constituted mainly by said cooperating means for adjustably interconnecting said free lateral edges with a predetermined spacing therebetween while thus simultaneously separating one said breast cup from its adjacent said breast cup, an overlapping auxiliary body member comprising a main panel and a diagonal support panel extending from the lower corner of the main panel to the upper corner of the other side of the main panel, and means for securing the overlapping auxiliary body member to the front of the body encircling portion; and means for adjustably securing said halter top to the upper chest portion of a female body; whereby in use, the breasts are held firmly yet comfortably against the body, with the breasts being urged towards each other and inwardly towards the body.

By a further feature, the overlapping auxiliary body member comprises a quadrilateral-shaped main panel whose width is substantially the same width as that of the body encircling portion, and a diagonal support panel having a plurality of longitudinally extending pleats extending between one lower edge and its opposed upper edge, the lower edge being secured to the main panel in such a manner that when the overlapping auxiliary body member is secured to the body encircling portion, the pleats at such lower edge are disposed at substantially the axilary line of the halter top.

By another feature, the width of the assembled main panel and auxiliary diagonal support panel is substantially the same at each edge thereof.

By yet another feature, the halter top includes means for detachably securing the overlapping auxiliary body member to the body encircling portion.

By still another feature of this invention, a complete sports outfit for females is provided comprising: a halter top formed of substantially non-stretchable material and comprising the combination of:

(a) a body encircling portion constituted by a discontinuous panel having a pair of free lateral edges and cooperating means at said free lateral edges to hold said free lateral edges together, said body encircling portion being provided with (i) a pair of discrete, separated breast-receiving and supporting cups, each said cup including a vertical seam therein bisecting said cup, the preselected variable but permanent location of said vertical seam thereby providing preselected different cup sizes, the top edge of said breast-receiving and supporting cup being so curved as to follow the natural incline of said breasts, the lower edge of said breast receiving and supporting cups being so curved as to fit below the breasts, and (ii) means constituted mainly by said cooperating means for adjustably interconnecting said free lateral edges with a predetermined spacing therebetween while thus simultaneously separating one said breast cup from its adjacent said breast cup; and (b) means for adjustably securing said halter top to the upper chest portion of a female body; whereby, in use, the breasts are held firmly yet comfortably against the body, with the breasts being urged towards each other and inwardly towards the body; and jogging shorts comprising: a main body portion having an adjustable waist band and a pair of depending legs, with side seams along the outside edges of the legs thereof; and means associated with, and extending along, the side seams for adjusting the lengths of the seams.

By yet a further feature of this invention, a complete sports outfit for females is provided comprising: a halter top formed of substantially non-stretchable material and comprising the combination of:

(a) a principal body encircling portion constituted by a discontinuous panel having a pair of free lateral edges and cooperating means at said free lateral edges to hold said free lateral edges together, said body encircling portion being provided with (i) a pair of discrete, separated, breast-receiving and supporting cups, each said cup including a vertical seam therein bisecting said cup, the preselected variable but permanent location of said vertical seam thereby providing preselected different cup sizes, the top edge of said breast-receiving and supporting cup being so curved as to follow the natural incline of said breasts, the lower edge of said breast receiving and supporting cups being so curved as to fit below the breasts; and (ii) means constituted mainly by said cooperating means for adjustably interconnecting said free lateral edges with a predetermined spacing therebetween while thus simultaneously separating one said breast cup from its adjacent said breast cup;

(b) an overlapping auxiliary body member comprising:

(iii) a main panel;

(iv) a diagonal support panel extending from the lower corner of said main panel to the upper corner of the other side of said main panel; and (v) means for securing said overlapping auxiliary body member to the front of said body encircling portion; and (c) means for adjustably securing said halter top to the upper chest portion of a female body; whereby, in use, the breasts are held firmly yet comfortably against the body, with the breasts being urged towards each other and inwardly towards the body; and II. jogging shorts comprising:

(vi) a main body portion having an adjustable waist band;

(vii) a pair of depending legs with side seams along the outside edges of the legs thereof; and (viii) means associated with and extending along, said side seams for adjusting the lengths.

By a further feature, the means associated with the side seams of the shorts include a longitudinal pocket along each such side seam and strings disposed within the pockets, whereby pulling of the strings adjusts the length of the seams.

BRIEF DESCRIPTION OF THE DRAWINGS

In the accompanying drawings.

Figure 1:
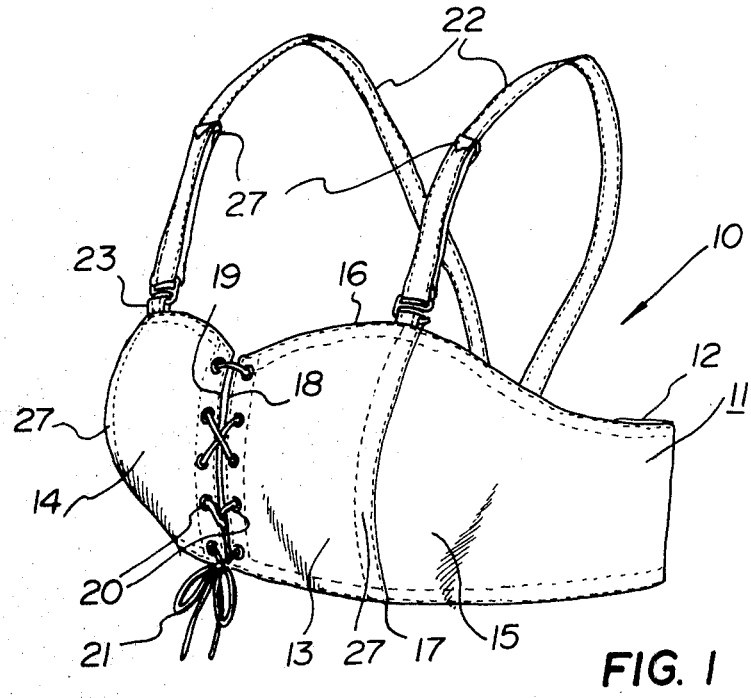
FIG. 1 is a front perspective view of the halter top of one embodiment of this invention.
Figure 2:
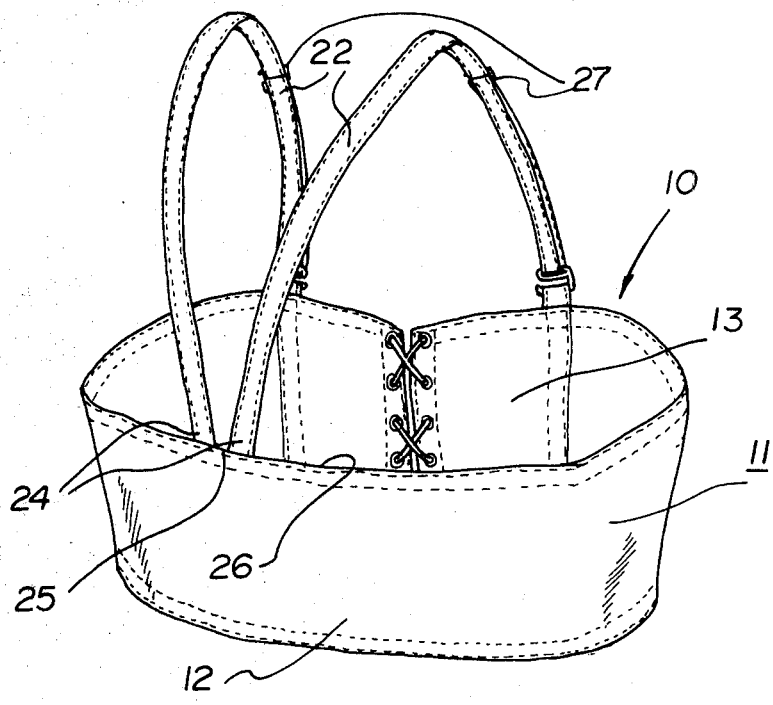
FIG. 2 is a back perspective view of the halter top of FIG. 1.

DESCRIPTION OF PREFERRED EMBODIMENTS (i) Description of FIGS. 1 and 2

As seen in FIGS. 1 and 2, the halter top 10 includes a body encircling discontinuous panel 11 including a back 12 and a front 13 having a pair of breast-receiving and supporting cups 14, 15. The upper lateral edge 16 of the front 13 is cut in a curved line to follow the natural incline of the breasts. The lower edge 17 of the front 13 is so curved as to fit below the breasts. An essential feature of this halter top 10 is the vertical bisecting seam 27 of each breast cup 14, 15 in order to provide means for creating different sizes of breast cup 14, 15. By this configuration, the breasts are held firmly yet comfortably against the body, with the breasts being urged towards each other and inwardly towards the body.

The free lateral edges 18, 19 are provided with a plurality of spaced-apart eyelets 20 through which a string 21 is laced to hold the lateral edges together. These means adjustably separate breast cups 14, 15 from one another. The tighter the lacing, the closer the breasts are pushed towards one another and towards the body.

The halter top is secured to the body of the wearer by means of a pair of straps 22 each secured at one end 23 to the upper edge 16 adjacent a respective breast receiving and supporting pocket 14, 15 and at the other end 24 to the central portion 25 of the upper edge 26 of the back 12. The straps 22 are provided with adjusting clasps 27 so that the length thereof can be adjusted to adjust the distance from the breasts to the top of the shoulder.

Figure 3:
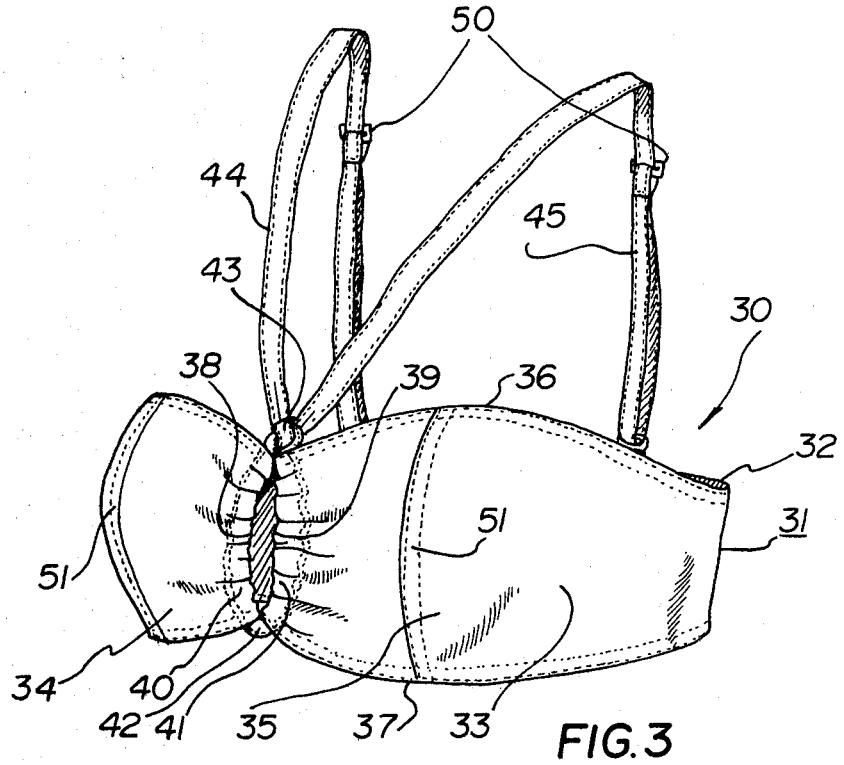
FIG. 3 is a front perspective view of the halter top of another embodiment of this invention.
Figure 4:
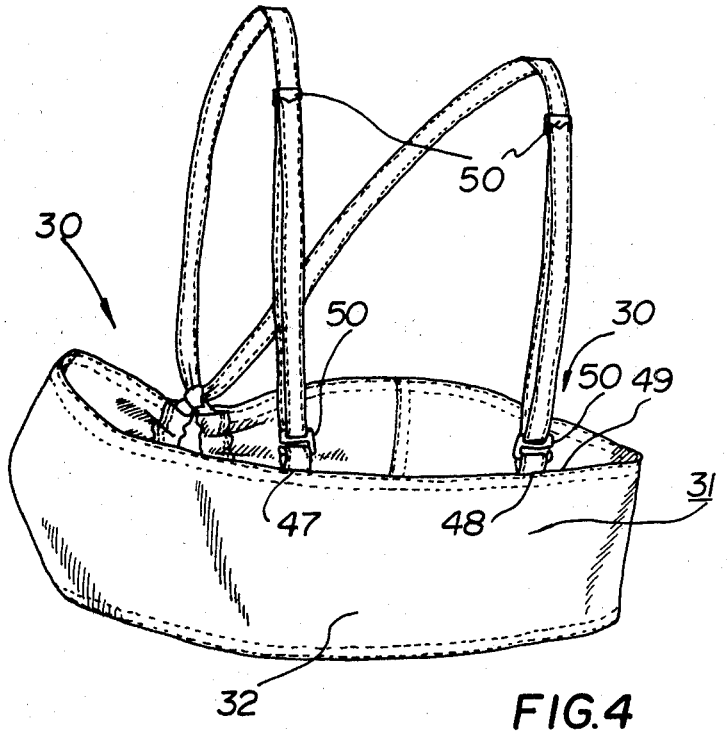
FIG. 4 is a back perspective view of the halter top of FIG. 3.

(ii) Description of FIGS. 3 and 4

As seen in FIGS. 3 and 4, the halter top 30 includes a body encircling discontinuous panel 31 including a rear panel 32 and a front panel 33, including a pair of spaced-apart breast-receiving and supporting cups 34, 35. The top edge 36 of front panel 33 is so curved as to follow the natural incline of the breasts. The lower edge 37 of the front panel 33 is so curved as to fit below the breasts. An essential feature of the halter top 30 is the vertical bisecting seam 51 in each breast cup 34, 35 in order to provide means for creating different sizes of breast cup 34, 35. By this construction, the breasts are held firmly yet comfortably against the body, with the breasts being urged towards each other and inwardly towards the body.

The free lateral edges of 38, 39 of the panel 31 are provided with enclosed pockets 40, 41. Within pockets 40, 41 is a tie strap 42 which serves to hold the two lateral edges 38, 39 adjustably together. The tie straps 42 are knotted at 43. These means adjustably separate breast cups 34, 35 from one another. The shorter the loop of string 42 at the knot 43, the closer the breasts are pushed towards one another and towards the body. The string 42 beyond knot 43 extends as shoulder straps 44, 45 to be secured to spaced-apart portions 47, 48 at the upper edge 49 of the back 32. The straps 44, 45 are provided with adjusting clasps 50 so that the length thereof can be adjusted to adjust the distance from the breasts to the top of the shoulder.

Figure 5:
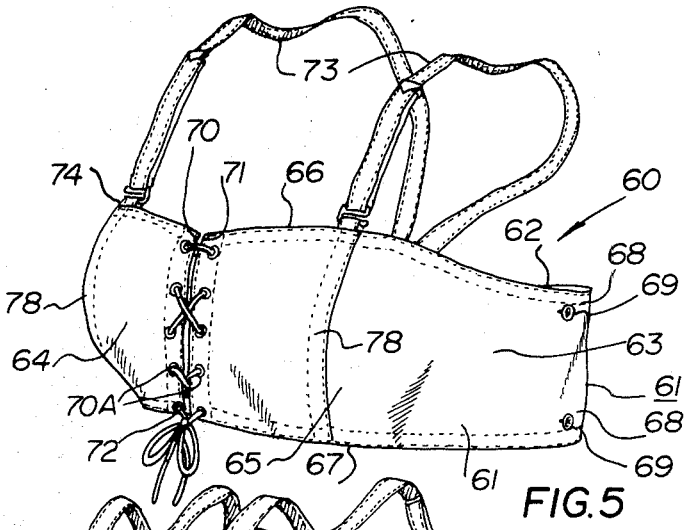
FIG. 5 is a front perspective view of the halter top of yet another embodiment of this invention.
Figure 6:
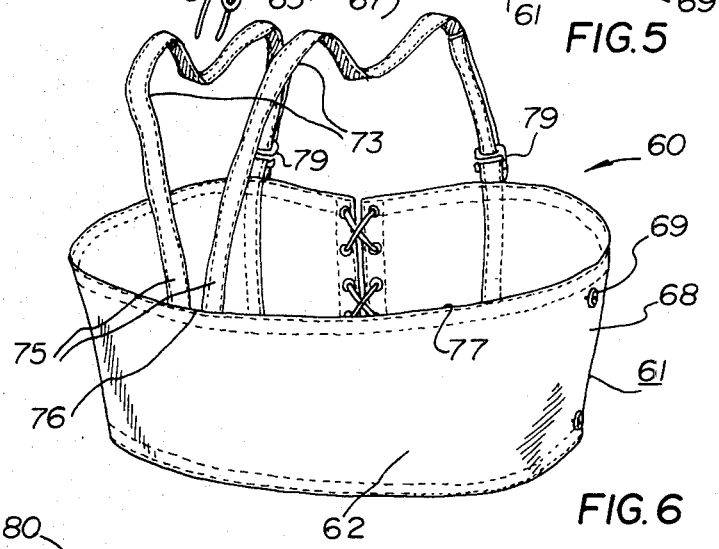
FIG. 6 is a rear perspective view of the halter top of FIG. 5.

(iii) Description of FIGS. 5 and 6

As seen in FIGS. 5 and 6, the halter top 60 comprises a discontinuous panel 61 including a back panel 62 and a front panel 63 having a pair of spaced-apart breast-receiving and supporting cups 64, 65. The top edge 66 of the front panel 63 is so curved as to follow the natural incline of the breasts. The lower edge 67 of the front panel 63 is so curved as to fit below the breasts. An essential feature of the halter top 60 is the vertical bisecting seam 78 in each breast cup 64, 65, in order to provide means for creating different sizes of breast cup 64, 65. By this construction, the breasts are held firmly yet comfortably against the body, with the breasts being urged towards each other and inwardly towards the body. The opposed corners 68 of the outer lateral edges of the front panel 63 are provided with detachable securing means in the form of buttons 69. Other equivalent detachable securing means, e.g., hooks, VELCRO, etc., may also be used.

At the free lateral edges 70, 71 of front panel 63 are a plurality of vertically aligned eyelets 70, through which are laced adjusting string 72. These means adjustably separate breast cups 64, 65 from one another. The tighter the lacing, the closer the breasts are pushed towards one another and towards the body.

The halter top 60 is secured to the body of the wearer by means of a pair of straps 73, each secured at one end 74 to the upper edge 66 adjacent a respective breast-receiving and supporting cup 64, 65, and at the other end 75 to the central portion 76 of the upper edge 77 of the back 62. The straps 73 are provided with adjusting clasps 79 so that the length thereof can be adjusted to adjust the distance from the breasts to the shoulder.

Figure 7:
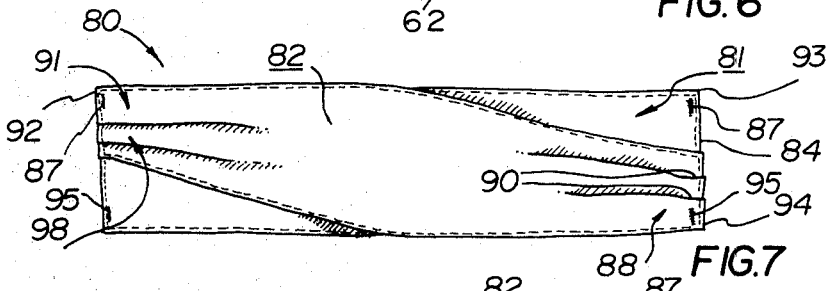
FIG. 7 is a front elevational view of the overlapping auxiliary body member forming an adjunct to the halter top of FIG. 5.
Figure 8:
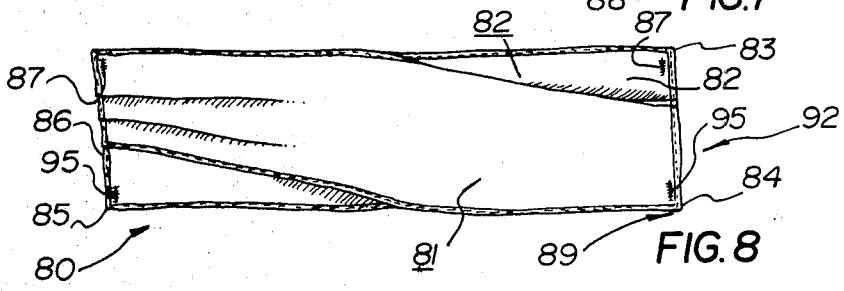
FIG. 8 is a rear elevational view of the auxiliary body member of FIG. 7.

(iv) Description of FIGS. 7 and 8

As seen in FIGS. 7 and 8, the auxiliary overlapping body member 80 comprises a main panel 81 and a diagonal support panel 82. Main panel 81 is generally of quadrilateral shape and is provided at one upper corner 83 of one lateral edge 84, and at another lower corner 85 of its other lateral edge 86 with detachable securing means in the form of buttonholes 87, although other equivalent means, e.g., hooks, VELCRO, etc., may be used.

The diagonal support panel 82 is generally quadrilaterally shaped, and at one lower corner region 88 of one lateral edge 89 is provided with a plurality, e.g., three pleats 90 which extend to the upper opposed area 91 of the other lateral edge 92. Area 98 is permanently secured as by stitching to the corner of lateral edge 86 over which it is superimposed. At the other upper corner 93 of the other edge 89, and at the opposed lower corner 94 of the other edge 92 are detachable securing means in the form of button holes 95, although other equivalent means, e.g., hooks, VELCRO, etc., may also be used.

When assembled, the width of exposed lateral edges 86 and 89 is substantially the same as the width of the one lateral edge 86, and the total width of exposed lateral edges 84 and 92 is substantially the same as the width of the other lateral edge 86. Also area 88 is at the axilary region when the halter top 60 is worn.

When assembled as a halter top 60 of this aspect of the present invention, the cups 64, 65 are so curved as to fit below the breasts that the breasts are held firmly yet comfortably against the body, with the breasts being urged towards each other and inwardly towards the body. In addition, body members are provided having an overlapping bust supporting and modesty provision portion which aids in achieving the main objects of this invention and of covering the breast cleavage.

Figure 9:
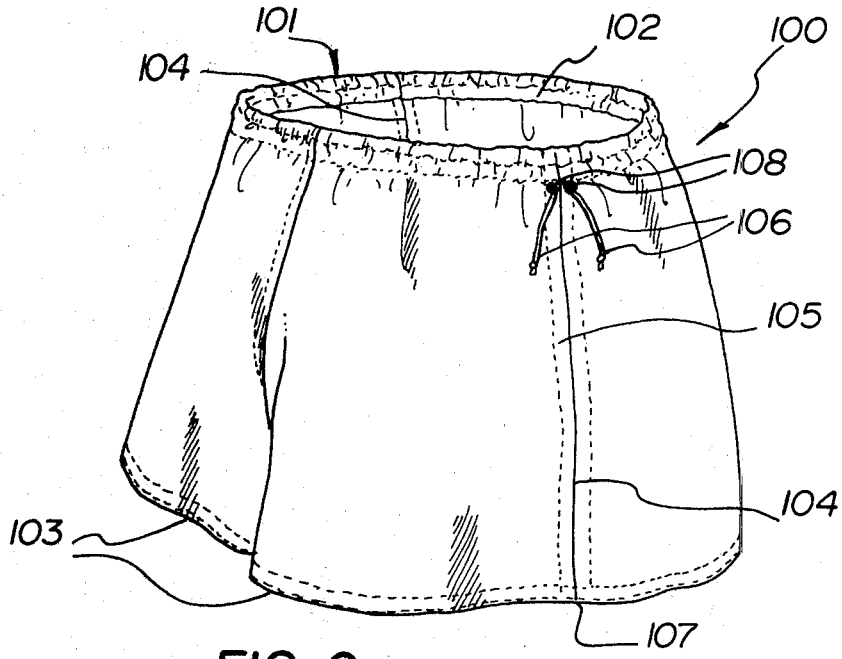
FIG. 9 is a front perspective view of the sports shorts of another embodiment of this invention, in one orientation.
Figure 10:
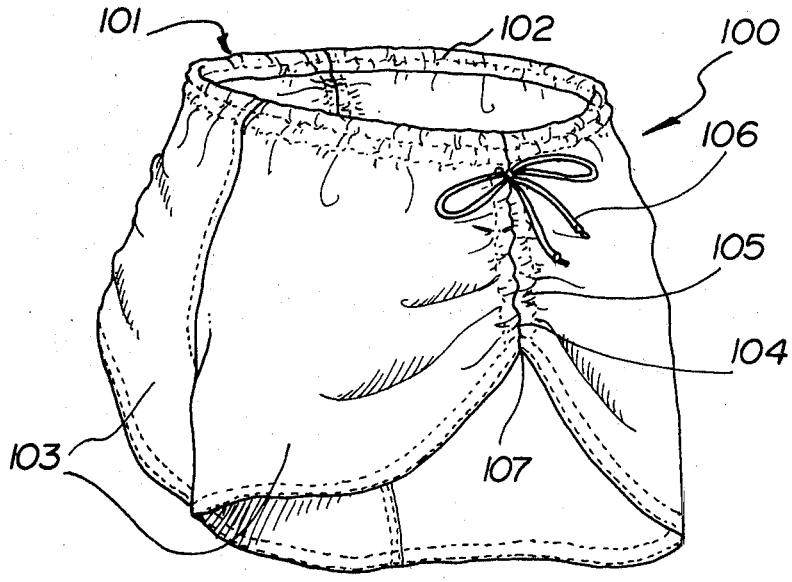
FIG. 10 is a front perspective view of the sports shorts of FIG. 9, in an adjusted orientation.

(v) Description of FIGS. 9 and 10

The sports shorts 100 of FIGS. 9 and 10 include a main waist portion 101 including an adjustable waist band 102 in the form of an elastic band, although other equivalent means may be used. A pair of depending legs 103 having outside lateral seam edges 104 are also provided. At each of the seam edges are pockets 105, within which are secured respective pull-strings 106, secured at the bottom edge 107 of the pockets 105, but passing through eyelets 108 at the top edge thereof adjacent the waist band 102.

In this way, pulling the strings 106 adjusts the length of the seam edge 104 for comfort.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim:

1. A halter top formed of substantially non-stretchable material for a sports outfit for females comprising the combination of:

(a) a body encircling portion constituted by a discontinuous panel having a pair of free lateral edges and cooperating means at said free lateral edges to hold said free lateral edges together, said body encircling portion being provided with (i) a pair of discrete, separated breast-receiving and supporting cups, each said cup including a vertical seam therein bisecting said cup, the preselected variable but permanent location of said vertical seam thereby providing preselected different cup sizes, the top edge of said breast-receiving and supporting cup being so curved as to follow the natural incline of said breasts, the lower edge of said breast-receiving and supporting cups being so curved as to fit below the breasts, and (ii) means constituted mainly by said cooperating means for adjustably interconnecting said free lateral edges with a predetermined spacing therebetween while thus simultaneously separating one said breast cup from its adjacent said breast cup;

(b) means for adjustably securing said halter top to the upper chest portion of a female body;

whereby, in use, the breasts are held firmly yet comfortably against the body, with the breast being urged towards each other and inwardly towards the body.

2. The halter top of claim 1 wherein said cooperating means comprising lacings between said free lateral edges.

3. The halter top of claim 1 wherein said cooperating means comprising vertical pockets adjacent each said free lateral edge, and string means disposed within said pockets and secured together.

4. The halter top of claim 2 wherein said means for adjustably securing the halter top to the body comprises a pair of spaced-apart shoulder straps, extending between the upper edge of the breast-receiving and supporting cups and the central area of the back of the body encircling portion, said straps being adjustable in length to adjust the distance from the breasts to the top of the shoulder.

5. The halter top of claim 3 wherein said means for adjustably securing the halter top to the body comprises straps extending from said string means at the front between said breast-receiving and supporting pockets to spaced-apart areas at the upper back edge of the halter top, said straps being adjustable in length to adjust the distance from the breasts to the top of the shoulder.

6. A halter top formed of substantially non-stretchable material for a sports outfit for females comprising the combination of:

(a) a principal body encircling portion constituted by a discontinuous panel having a pair of free lateral edges and cooperating means at said free lateral edges to hold said free lateral edges together, said body encircling portion being provided with (i) a pair of discrete, separated breast-receiving and supporting cups, each said cup including a vertical seam therein bisecting said cup, the preselected variable, but permanent, location of said vertical seam thereby providing preselected different cup sizes, the top edge of said breast-receiving and supporting cup being so curved as to follow the natural incline of said breasts, the lower edge of said breast receiving and supporting cups being so curved as to fit below the breasts, and (ii) means constituted mainly by said cooperating means for adjustably interconnecting said free lateral edges with a predetermined spacing therebetween while thus simultaneously separating one said breast cup from its adjacent said breast cup;

(b) an overlapping auxiliary body member comprising:

(iii) a main panel;

(iv) a diagonal support panel extending from the lower corner of said main panel to the upper corner of the other side of said main panel; and (v) means for securing said overlapping auxiliary body member to the front of said body encircling portion; and (c) means for adjustably securing said halter top to the upper chest portion of a female body;

whereby, in use, the breasts are held firmly yet comfortably against the body, with the breast being urged towards each other and inwardly towards the body.

7. The halter top of claim 6 wherein said overlapping auxiliary body member comprises a quadrilateral-shaped main panel whose width is substantially the same width as that of the body encircling portion, and a diagonal support panel having a plurality of longitudinally extending pleats extending between one lower edge and its opposed upper edge, the lower edge being secured to said main panel in such a manner than when the overlapping auxiliary body member is secured to said body encircling portion, the pleats at such lower edge are disposed at substantially the axilary line of the halter top.

8. The halter top of claim 7 wherein the width of the assembled main panel and auxiliary diagonal support panel is substantially the same at each edge thereof.

9. The halter top of claim 8 including means for detachably securing the overlapping auxiliary body member to said body encircling portion.

10. A complete sports outfit for females comprising:

I. a halter top formed of substantially non-stretchable material and comprising the combination of:

(a) a body encircling portion constituted by a discontinuous panel having a pair of free lateral edges and cooperating means at said free lateral edges to hold said free lateral edges together, said body encircling portion being provided with (i) a pair of discrete, separated, breast-receiving and supporting cups, each said cup including a vertical seam therein bisecting said cup, the preselected variable but permanent location of said vertical seam thereby providing preselected different cup sizes, the top edge of said breast-receiving and supporting cup being so curved as to follow the natural incline of said breasts, the lower edge of said breast receiving and supporting cups being so curved as to fit below the breasts, and (ii) means constituted mainly by said cooperating means for adjustably interconnecting said free lateral edges with a predetermined spacing therebetween while thus simultaneously separating one said breast cup from its adjacent said breast cup; and (b) means for adjustably securing said halter top to the upper chest portion of a female body;

whereby, in use, the breasts are held firmly yet comfortably against the body, with the breast being urged towards each other and inwardly towards the body; and II. jogging shorts comprising:

(iii) a main body portion having an adjustable waist band;

(iv) a pair of depending legs with side seams along the outside edges of the legs thereof; and (v) means associated with, and extending along, said seams for adjusting the lengths of said seams.

11. A complete sports outfit for females comprising:

I. a halter top formed of substantially non-stretchable material and comprising the combination of:

(a) a principal body encircling portion constituted by a discontinuous panel having a pair of free lateral edges and cooperating means at said free lateral edges to hold said free lateral edges together, said body encircling portion being provided with (i) a pair of discrete, separated, breast-receiving and supporting cups, each said cup including a vertical seam therein bisecting said cup, the preselected variable but permanent location of said vertical seam thereby providing preselected different cup sizes, the top edge of said breast-receiving and supporting cup being so curved as to follow the natural incline of said breasts, the lower edge of said breast receiving and supporting cups being so curved as to fit below the breasts; and (ii) means constituted mainly by said cooperating means for adjustably interconnecting said free lateral edges with a predetermined spacing therebetween while thus simultaneously separating one said breast cup from its adjacent said breast cup;

(b) an overlapping auxiliary body member comprising:

(iii) a main panel;

(iv) a diagonal support panel extending from the lower corner of said main panel to the upper corner of the other side of said main panel; and (v) means for securing said overlapping auxiliary body member to the front of said body encircling portion; and (c) means for adjustably securing said halter top to the upper chest portion of a female body;

whereby, in use, the breasts are held firmly yet comfortably against the body, with the breasts being urged towards each other and inwardly towards the body; and II. jogging shorts comprising:

(vi) a main body portion having an adjustable waist band;

(vii) a pair of depending legs with side seams along the outside edges of the legs thereof; and (viii) means associated with and extending along, said side seams for adjusting the lengths.

12. The halter top combination of claim 10 or 11 wherein said means associated with said side seams of said shorts include a longitudinal pocket along each said side seam and strings disposed within said pockets, whereby pulling of the strings adjusts the length of the seams.

* * * * *